US011549331B2

(12) United States Patent
Herland

(10) Patent No.: US 11,549,331 B2
(45) Date of Patent: Jan. 10, 2023

(54) GATE VALVE ASSEMBLY FOR A SUBSEA WORKOVER SYSTEM

(71) Applicant: Aker Solutions AS, Lysaker (NO)

(72) Inventor: Jan Herland, Nesbru (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 17/280,445

(22) PCT Filed: Oct. 4, 2019

(86) PCT No.: PCT/EP2019/076873
§ 371 (c)(1),
(2) Date: Mar. 26, 2021

(87) PCT Pub. No.: WO2020/070266
PCT Pub. Date: Apr. 9, 2020

(65) Prior Publication Data

US 2022/0003073 A1 Jan. 6, 2022

(30) Foreign Application Priority Data

Oct. 5, 2018 (NO) ..... 20181288

(51) Int. Cl.
*E21B 34/04* (2006.01)

(52) U.S. Cl.
CPC ..... *E21B 34/04* (2013.01)

(58) Field of Classification Search
CPC ..... E21B 34/04
See application file for complete search history.

(56) References Cited

U.S. PATENT DOCUMENTS 2,386,841 A * 10/1945 Cooke ..... E21B 33/04 29/213.1
5,370,362 A 12/1994 Kent et al.
(Continued)

FOREIGN PATENT DOCUMENTS

GB 2464604 A 4/2010
NO 20131528 A1 5/2015
(Continued)

OTHER PUBLICATIONS

Ing, James; International Search Report; PCT/EP2019/076873; dated Dec. 20, 2019; 4 pages.

*Primary Examiner* — Aaron L Lembo
(74) *Attorney, Agent, or Firm* — Shackelford, Bowen, McKinley & Norton, LLP

(57) ABSTRACT

The invention relates to a gate valve assembly (20) for use in a subsea workover system comprising: —a valve block (22) having a flow path (21*c*); —valve seats (33, 34) located within the valve block (22) around a periphery of the flow path (21*c*), —a gate valve member (40) which is moveable across the flow path (21*c*) between a first position in which the flow path (21*c*) is open and a second position in which the flow path (21*c*) is closed; —said gate valve member (40) comprising a first portion (31) surrounding an opening (32) adapted to mate with the flow path (21*c*) when the gate valve member (40) is in the first position, said first portion (31) is provided with a cutting member (30) arranged on the periphery of the first portion (31) towards the opening (32). The gate valve member (40) further comprises a second portion (41) having at least one recessed part (42, 43), said recessed part (42, 43) being positioned such that when the gate valve member (40) is in the second position, the gate valve member (40) and the seats (33, 34) forms a sealing
(Continued)

area (44, 45) arranged on a planar surface of the gate valve member (40).

8 Claims, 5 Drawing Sheets

(56) References Cited

U.S. PATENT DOCUMENTS

| | | | | |
|---|---|---|---|---|
| 10,006,266 | B2 * | 6/2018 | Sundararajan | E21B 33/038 |
| 10,704,352 | B2 * | 7/2020 | Lycke | E21B 44/00 |
| 2010/0102263 | A1 | 4/2010 | Liew | |
| 2014/0014356 | A1 | 1/2014 | Herland et al. | |
| 2016/0060995 | A1 | 3/2016 | Skeels et al. | |
| 2020/0063520 | A1 * | 2/2020 | Holberg | E21B 33/043 |

FOREIGN PATENT DOCUMENTS

| | | | | |
|---|---|---|---|---|
| WO | WO-2012093312 | A1 | 7/2012 | |
| WO | WO-2014144792 | A2 | 9/2014 | |
| WO | WO-2015072862 | A1 | 5/2015 | |
| WO | WO-2018096312 | A1 | 5/2018 | |
| WO | WO-2018190727 | A1 * | 10/2018 | E21B 34/04 |

* cited by examiner

GATE VALVE ASSEMBLY FOR A SUBSEA WORKOVER SYSTEM

TECHNICAL FIELD

The invention relates to a gate valve for use in connection with oil and gas production, especially for use in relation to a subsea workover system according to the ingress of the subsequent claim 1.

BACKGROUND ART

An open water Workover System consists of a Lower riser package (LRP) and an emergency disconnect package (EDP), a Workover Riser and a Surface Flow Tree. During preparations for a wireline operation through the Workover System, a tool string is lowered into the riser at Rig level.

A gate valve is in such system used as a barrier function valve in the Workover stack in either LRP or EDP.

During oil and gas production, and in particular during work-over and testing wells, wire line operations are common. Various tools and instruments are supported and manipulated by a string, for instance cables, lines, wires, coils or piano wires. These strings are passing through the wellhead when performing operation in the well by the tools or instruments.

Ideally, the string is removed from the workover riser system before the gate valve is closing. However, during emergency situations, there is no time to remove the string before the valve is closing, resulting in that the valve is closing when the string is present in the valve. The valve must then cut the string in order to close and maintain the seal after the valve is seated. A gate valve provided with cutting mechanism is known from the previous applications by the same applicant NO20131528 and WO2012/093312. The gate valve according to the invention may contain any of the features present in these applications.

During the preparations part of the wire line operation, the barrier valves of the LRP and EDP are normally closed. If parts of the tool string or the whole tool string should be accidentally dropped during this initial part of the wireline operation, the parts could fall hundreds of meters down the Workover Riser before they hit the closed gate of any of the Subsea barrier valves. Such a hit would most likely damage the surface of the gate and hence ruin the sealing capability of the valve when opened and closed again. This would likely lead to an aborted operation and retrieval of the Workover System to surface for inspection and potential repair.

This may also occur in the Christmas tree when attached to the workover system, a gate valve according to the invention may therefore also be arranged in the Christmas tree.

The surface of the gate valve is equipped with a coating for wear resistance and sealability. This coating is typically made of a hard material such as tungsten carbide or similar hard substance which makes the gate able to slide smooth and easily on the surface of the seats between the open position and the closed position. The material is very hard but is not able to withstand object that hits the surface, ie to withstand concentrated load.

It is however necessary that the gate valve member have this coating to provide an easy opening and closing of the gate and to avoid wear.

If an object is falling inside the system and hit the surface of the gate valve member when the gate valve is closed, this would result in a cracking of the coating in this area and possible damage of the base material. The result of this is that the area becomes a rough surface not suitable for sliding the gate valve member across the seat sealing surface inside the valve housing. Consequently, the gate valve member must be replaced or repaired, which would be very costly since the gate valve is positioned in the LRP or EDP near the wellhead of the work over system, which could be in the deep-water area of the sea. The entire stack (LRP or EDP) must be removed and brought the sea-surface for replacement or maintenance.

The publication WO 2018/096312 A1, describes a way of protecting the gate from dropped objects by making a recess in the gate surface. However, the publication describes in detail in the application and in the first claim that the seats (upper and lower) shall both seal inside the conical surface forming the recess when the valve is in the closed position.

The solution in this publication thus requires that the positioning of the gate with respect to the seals must be very accurate in order for the gate valve to maintain its sealing properties.

The invention is further initiated to meet new and stricter requirements from applicable industry standards and customer specifications with respect to documented dropped object performance.

The present invention thus provides a robust and reliable product that would avoid or reduce unnecessary maintenance of the system and eliminate the above disadvantage of the prior gate valves.

SUMMARY OF INVENTION

The invention relates to a gate valve assembly for use in a subsea workover system comprising a valve block having a flow path;

valve seats located within the valve block around a periphery of the flow path, a gate valve member which is moveable across the flow path between a first position in which the flow path is open and a second position in which the flow path is closed;

said gate valve member comprising a first portion surrounding an opening adapted to mate with the flow path when the gate valve member is in the first position, said first portion is provided with a cutting member arranged on the periphery of the first portion towards the opening. The gate valve member further comprises a second portion having at least one recessed part, said recessed part being positioned such that when the gate valve member is in the second position, the gate valve member and the seats forms a sealing area on a planar surface of the gate valve member.

Preferably, the sealing area is arranged outside of the at least one recessed part.

Preferably, the diameter of the at least one recessed part is equal or less than the inner diameter of the seats.

Preferably, the surface of the at least one recessed part is the same as the core material of the gate valve member.

Preferably, a first recessed part is arranged on the surface facing a sea surface of the gate valve member, when arranged in the subsea workover system.

Preferably, the gate valve member comprising a second recessed part, said second recessed part being arranged on the opposite side of the gate valve member than the first recessed part, said second recessed part is equal to the first recessed part.

The invention further relates to an emergency disconnect package for use in a subsea workover system comprising a gate valve according to the invention.

The invention also relates to a lower riser package for use in a subsea workover system comprising a gate valve according to the invention.

The invention also related to a Christmas tree for use in a subsea workover system comprising a gate valve according to the invention.

OBJECT OF THE INVENTION

The gate valves in the main bore of the LRP stack will include a gate with tungsten carbide coating on the top and bottom sealing surface. This surface is polished to mirror finish to be able to seal for gas. In addition to the high surface finish, the tungsten carbide coating is very hard and hence also very brittle when exposed to impact point loads. The surface of the closed gate in the center of the valve bore is therefore not very suited to accept any hard, mechanical impact loads from dropped objects.

The invention will eliminate the damaging effect of a dropped object by removing the coating in a circular area inside the valve bore diameter and hence remove the negative effect of tungsten carbide or similar material being cracked during a mechanical impact. Further the same surface will be slightly recessed into the gate so that any mechanical damage and notches formed in the surface as a result from the mechanical impact will not get in contact with the valve seats when the valve is operated from a second closed position to a first, open position after an impact incident. Hence the new gate design will tolerate dropped objects as the sealing surface between gate and seat on the top of the gate will be fully protected outside the valve bore and outside the recessed area. Any damage to the gate surface will not affect the seats when valve is opened and closed again.

DETAILED DESCRIPTION OF THE INVENTION

The term "subsea workover system" must be interpreted to also include the Christmas tree when the workover system is connected to this Christmas tree at the seabed. The gate valve according to the invention is also suitable for use in such a Christmas tree in a similar way as described for the gate valve of the EDP and LRP.

The term "string" is to be interpreted in the broadest possible way. The string could for instance be one or more of a wire, a cable, a coiled tubing, a pipeline, a slickline etc.

Figure 1:
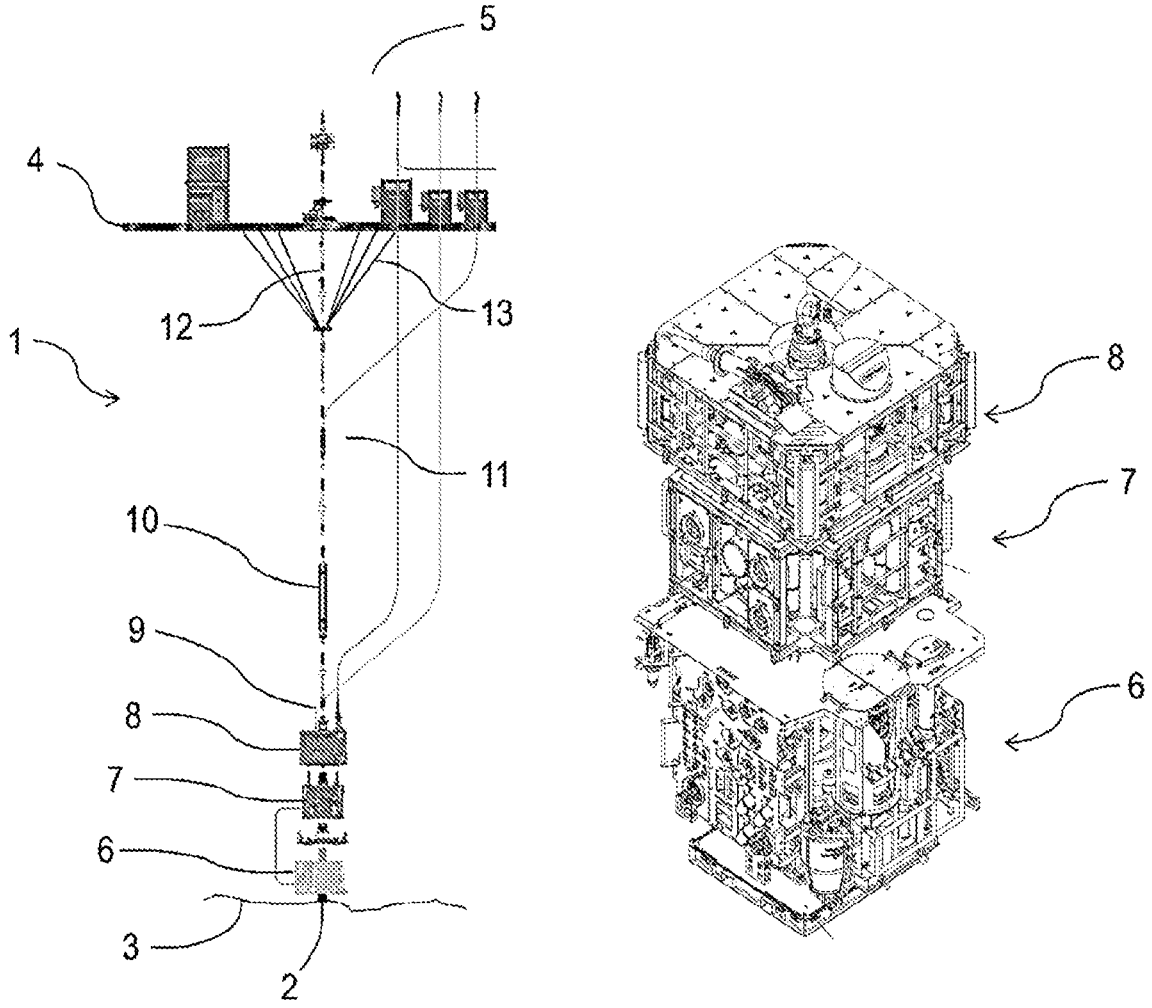
FIG. 1 shows an overview of a typical work over system where the gate valve assembly according to the invention is used, The FIG. 1 further shows a perspective view of an emergency disconnection package (EDP), a lower riser package (LRP) and a Christmas tree where the gate valve assembly according to the invention could be installed.

FIG. 1 shows an overview of a typical subsea work over system in which a gate valve assembly according to the invention is used.

The figure shows typical main components in a subsea work over system 1 from a wellhead 2 on the seabed 3 to a rig deck 4 situated at the sea surface 5. Listed from the wellhead the subsea work over system may comprise the following elements:

A Christmas tree 6 connected to the wellhead 2, a lower riser package 7 and a emergency disconnected package 8 arranged above the Christmas tree 6, a riser 11 with possible addition of joints, such as stress joint 9, safety joint 10, landing joint 12 as shown in the figure. In addition to this, the riser is tensioned by a tension arrangement 13 situated between the rig deck 4 and the riser 11. The subsea work over system 1 as such is well known for a skilled person in the art.

Figure 2:
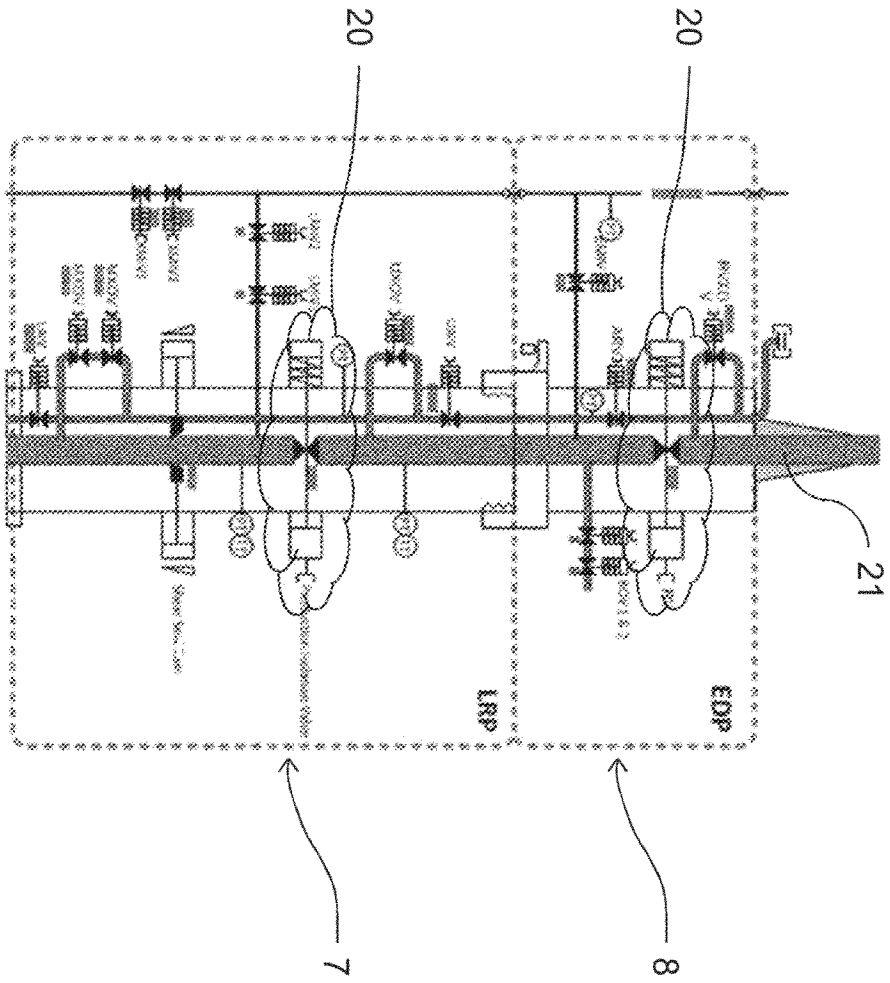
FIG. 2 shows a schematic view of the EDP and LRP with the gate valve assembly according to the invention.

The emergency disconnect package (EDP) 8 and the lower riser package (LRP) 7 are further illustrated in detail in FIGS. 1 and 2.

Both these packages 7, 8 are used under normal operating conditions. When required to do so the EDP 8 disconnects from the LRP 7 and isolates the riser 11 from the well head 2.

As shown in FIG. 2 the lower riser package 7 and the emergency disconnect package 8 comprises a gate valve assembly 20 with a cutting member 30 for cutting a string or similar that could be present in the workover riser system as described in the introductory part of the application.

The FIG. 2 show one gate valve assembly 20 arranged in the emergency disconnect package 8 and one gate valve assembly 20 arranged in the lower riser package 7. There could however be arranged several gate valve assemblies 20 in both the emergency disconnect package 8 and the lower riser package 7, and possible also in the Christmas tree 6.

FIG. 2 further shows a flow path 21 extending through the work over system 1. The flow path 21 allows access to the wellhead 2 (FIG. 1) and further to the well (not shown) when the gate valve assembly(s) 20 is open.

Figure 3:
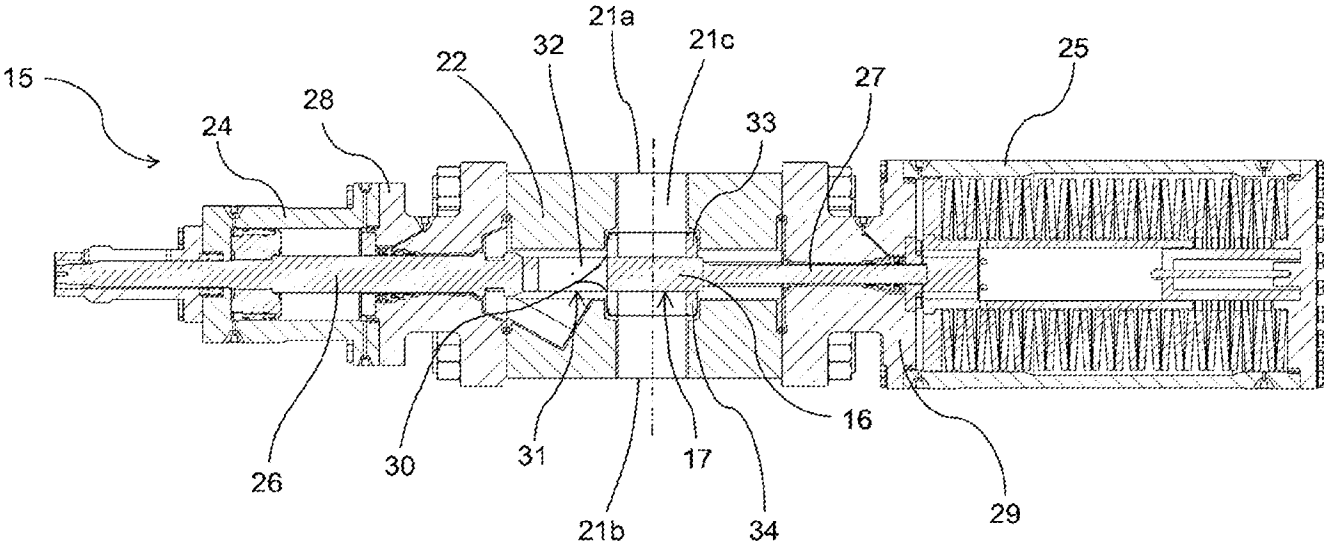
FIG. 3 shows a gate valve assembly with cutting performance according to prior art in a closed position.

FIG. 3 shows a gate valve assembly 15 according to prior art.

This gate valve assembly 15 according to prior art differs from a gate valve assembly 20 according to the invention in that a gate valve member 16 is constructed differently in the two solutions. The remaining features are equal in the prior art gate assembly 15 and the main parts of the gate valve assembly 20 according to the invention will be described in detail with reference to this FIG. 3.

This gate valve assembly 15 comprises a valve block 22 that houses one or more components of the gate valve assembly 15. The valve block 22 having a flow path 21*c* extending through the valve block 22 with an inlet opening 21*a* and an outlet opening 21*b* in the valve block. The flow path 21*c* allows the string or similar to pass through the valve block 22 and is part of the flow path 21 extending through the subsea workover system as described in relation to FIG. 2.

The gate valve assembly 15 further comprises a gate valve member 16 that can be operated by actuating mechanism 24, 25 to move the gate valve member 16 between a first position where the flow path 21*c* is open and a second position where the flow path 21*c* is closed. Possible actuators to move the gate valve member could for instance be a spring actuator 25 and a hydraulic actuator 24 that are mechanically connected to the valve block 22 as illustrated in the FIG. 3. The actuators 24, 25 may work together in the movement of the gate valve member 16.

The gate valve assembly may be connected to the actuators through connection members 28, 29.

The gate valve assembly 15 further comprises a shaft 26 guided and sealed within a first connection member 28 connected to the hydraulic actuator 24.

The shaft 26 is further connected in one end to the hydraulic actuator and in the other end connected to the gate valve member 16.

The gate valve assembly 15 further comprises a push rod 27 guided and sealed within a second connection member 29. The push rod 27 is arranged between the spring actuator 25 and the gate valve member 16.

The gate valve member 16 further comprising a first portion 31 having a cutting member 30. The first portion 31 having an opening or through hole 32 adapted to mate with the flow path 21*c* when the gate valve member 16 is arranged in the first position in the gate valve assembly 15.

The gate valve assembly 15 further having a set of annular valve seats 33, 34 arranged at each side of the gate valve member 16. The seats 33, 34 are further mounted coaxially with the flow path 21*c* with an inner diameter 33*a*, 34*a* substantial equal to the diameter of the flow path 21*c*. An end portion of each of the seats 33, 34 is facing the gate valve member 16. The seats 33, 34 having a circular shape around the flow path 21*c*.

Other arrangements of the gate valve assembly 15 such as other actuators and positions of the actuators, other ways for moving the gate valve member 16 or different cutting members 30 may be possible embodiments of the invention.

The gate valve member 16 according to prior art has further a second portion 17 that is planar through the whole surface. The seats 33, 34 bear against the second portion and seal the gate, when the gate valve is in the in the second, closed position.

Figure 4:
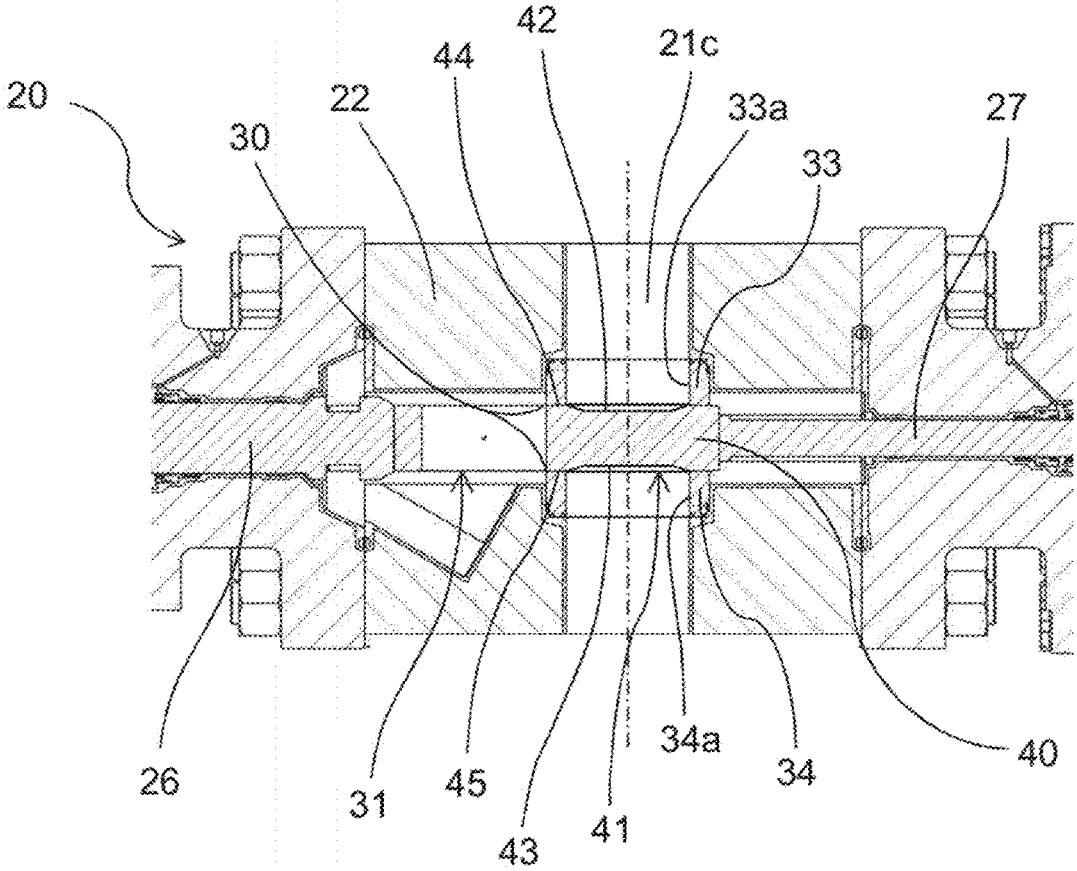
FIG. 4 shows a detail view of an embodiment of the gate valve assembly according to the present invention.

FIG. 4 shows the gate valve assembly 20 with a gate valve member 40 according to an embodiment of the present invention.

The gate valve member 40 has a first portion 31 as described in relation to FIG. 3.

The gate valve member 40 according to invention comprises further a second portion 41. The second portion has a recessed part 42. This part 42 is being positioned at the side or surface of the gate valve member 40 that is exposed to possible falling objects or similar. The recessed part 42 is further positioned so that when the gate valve member 40 is in the second, closed position, the recessed part 42 is arranged within the flow path 21*c*. The seat 33 is completely surrounding the recessed part 42. This results in that the seats 33 and the gate valve member 40 creates a planar sealing surface 44 as shown in the FIG. 4. The planar sealing surface 44 is formed by the shape of the seat facing the gate valve member 40. The sealing surface 44 is thus formed as circular ring outside of the recessed part 42. The inner boundary of the sealing surface 44 may not be at the inside of the recessed part 42.

The consequence of this is that the positioning of the gate valve member 40 after movement do not have to be accurate. The sealing surface 44 allows the gate valve member to be positioned within a range as long as each seal is completely contained in the planar sealing surface 44 when the gate valve member 40 is positioned in the second position. The inner diameter of the seal facing the flow path 21*c* must thus be larger or equal to the recessed part 42. The sealing surface 44 between the gate valve member 40 and the seats 33, 34 are clearly defined on the flat top and bottom planar surface of the gate valve member 40. The sealing surface 44 will thus be situated outside of the recessed area 42.

Figure 5:
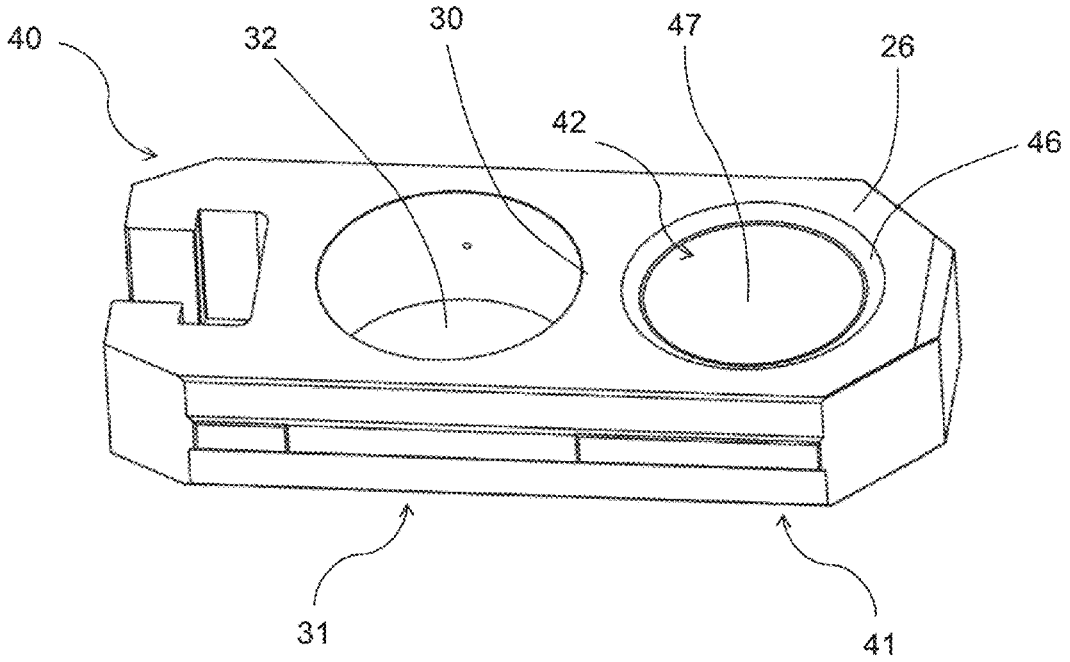
FIG. 5 shows a detail view of an embodiment of the gate valve member according to the present invention.

The recessed part 42 comprises a conical shape 46 towards the circular end portion, as shown in the FIG. 5. This will make a smoother transmission from the recessed part 42 to the upper surface of the valve block member 40. If for instance a tool is positioned in the recessed part 42 when the gate valve is in the second, closed position, this would not get stuck if the gate valve member 40 is moved to the first open position.

The term recessed part 42 includes both the conical shape 46 and a recessed shape 47 in the center of the recessed part 42.

The second portion 41 may optionally have a further recessed part 43 arranged at the opposite side of the gate valve member 40. The second recessed part 43 has the same position with the flow path 21*c* as the recessed part 42 and has the same shape as the first recessed part 42. The criteria as described above for the first recessed part 42 is also applicable for the second recessed part 43.

A planar sealing surface 45 is then formed by the shape of the seat 34 facing the gate valve member 40 at the bottom side of the gate valve member.

This embodiment with the two recessed parts 42, 43 is shown in FIG. 4.

This makes it possible to use both sides of the gate valve member 40. This will also reduce the risk of inserting the gate valve member 40 wrongly in the gate valve assembly 20.

The gate valve member 40 is shown isolated in FIG. 5. The figure shows first portion 31 with through hole 32 and cutting member 30. The cutting member 30 is arranged on the outer periphery of the first portion 31 surrounding the through hole 32 facing the second part 41. This makes the cutting most efficient when moving the gate valve member 40 to the second, closed position.

The figure further shows the second portion 41 with the recessed part 42, illustrated as a circular line in the figure. In the recessed part 42,43 the outer coating, such as tungsten carbide is removed so that the recessed part 42, 43 has a surface of the core material of the gate valve member 40. This core material could for instance be different grades of steel.

The present invention has been described with reference to a preferred embodiment and some drawings for the sake of understanding only and it should be clear to persons skilled in the art that the present invention includes all legitimate modifications within the ambit of what has been described hereinbefore and claimed in the appended claims.

The invention claimed is:

1. A gate valve assembly for use in a subsea workover system, the gate valve comprising:

a valve block having a flow path;

valve seats located within the valve block around a periphery of the flow path;

a gate valve member moveable across the flow path between a first position in which the flow path is open and a second position in which the flow path is closed; and wherein the gate valve member comprises:

a first portion surrounding an opening adapted to mate with the flow path when the gate valve member is in the first position, the first portion being provided with a cutting member arranged on the periphery of the first portion towards the opening;

a second portion having at least one recessed part, the at least one recessed part being substantially circular positioned at a side or surface exposed to a possible falling object and located inside the flow path when the gate valve member is in the second position, the gate valve member and the valve seats forming a sealing area arranged on a planar surface of the gate valve member;

wherein the sealing area is arranged outside of the at least one recessed part; and wherein the sealing area surrounds the at least one recessed part.

2. The gate valve assembly according to claim 1, wherein the diameter of the at least one recessed part is equal or less than the inner diameter of the seats.

3. The gate valve assembly according to claim 1, wherein the surface of the at least one recessed part is the same as the core material of the gate valve member.

4. The gate valve assembly according to claim 1, wherein a first recessed part is arranged on the surface facing a sea surface of the gate valve member, when arranged in the subsea workover system.

5. The gate valve assembly according to claim 1, wherein the gate valve member comprises a second recessed part, the second recessed part being arranged on the opposite side of the gate valve member than the first recessed part, the second recessed part being equal to the first recessed part.

6. An emergency disconnect package for use in a subsea workover system comprising the gate valve assembly according to claim 1.

7. A lower riser package for use in a subsea workover system comprising the gate valve assembly according to claim 1.

8. A Christmas tree for use in a subsea workover system comprising the gate valve assembly according to claim 1.

* * * * *